United States Patent [19]

Swinbanks

[11] Patent Number: 4,669,122

[45] Date of Patent: May 26, 1987

[54] DAMPING FOR DIRECTIONAL SOUND CANCELLATION

[75] Inventor: Malcolm A. Swinbanks, Cambridge, England

[73] Assignee: National Research Development Corporation, London, England

[21] Appl. No.: 744,734

[22] Filed: Jun. 14, 1985

[30] Foreign Application Priority Data

Jun. 21, 1984 [GB] United Kingdom ..... 8415833

[51] Int. Cl.[4] ..... H04R 1/28

[52] U.S. Cl. ..... 381/71; 381/94

[58] Field of Search ..... 381/71, 94, 73

[56] References Cited

U.S. PATENT DOCUMENTS

| | | | |
|---|---|---|---|
| 4,044,203 | 8/1977 | Swinbanks | 381/71 |
| 4,109,108 | 8/1978 | Coxon | 381/71 |
| 4,122,303 | 10/1978 | Chaplin | 381/71 |
| 4,171,465 | 10/1979 | Swinbanks | 381/71 |
| 4,423,289 | 12/1983 | Swinbanks | 381/71 |
| 4,473,906 | 9/1984 | Warnaka | 381/71 |
| 4,480,333 | 10/1984 | Ross | 381/71 |
| 4,489,441 | 12/1984 | Chaplin | 381/71 |
| 4,562,589 | 12/1985 | Warnaka | 381/71 |

FOREIGN PATENT DOCUMENTS

| | | |
|---|---|---|
| 1456018 | 11/1976 | United Kingdom . |
| 1548362 | 7/1979 | United Kingdom . |

OTHER PUBLICATIONS

"The Active Control of Low Frequency Sound in a Gas Turbine Compressor Installation", by M. A. Swinbanks, Inter-Noise '82, May 17-19, 1982.

"The Active Control of Sound Propagation in Long Ducts", by M. A. Swinbanks, Journal of Sound and Vibration (1973) 27(3), 411-436.

"An Experimental Study of a Broadband Active Attenuator for Cancellation of Random Noise in Ducts", La Fountaine et al., Journal of Sound and Vibration, (1983) 91(3), 351-362.

*Primary Examiner*—Gene Z. Rubinson

*Assistant Examiner*—L. C. Schroeder

*Attorney, Agent, or Firm*—Cushman, Darby & Cushman

[57] ABSTRACT

Sound in ducts can be reduced by using two cancelling sources spaced along the duct, and in order to reduce reflections upstream of the cancelling sources, sounds from these sources may be arranged to be in phase opposition upstream from the sources at all frequencies. Such an arrangement does not provide cancellation downstream at some frequencies. In the invention sound detected by a microphone is processed to generate a drive signal for a first source which tends to cancel sound in the duct partially, the remainder of the cancellation being provided by a sound source. A delay positioned between the sources is such that sounds from these sources are in phase at all frequencies of interest downstream of the second source.

12 Claims, 4 Drawing Figures

DAMPING FOR DIRECTIONAL SOUND CANCELLATION

Figure 1:
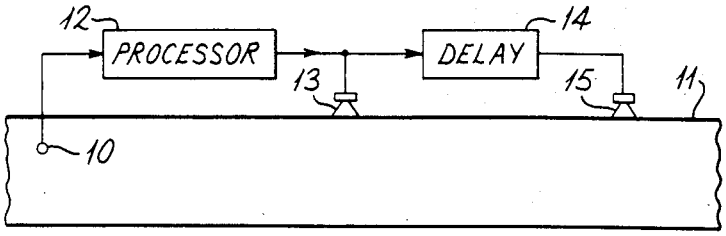

The present invention relates to apparatus and methods for reducing sound transmitted in a given direction by providing cancellation while at the same time damping reflections from a zone generating cancelling sounds. The invention is particularly, but not exclusively, applicable to the cancellation of sound in ducts. In the present inventor's paper "The Active Control of Sound Propagation in Long Ducts", Journal of Sound and Vibration (1973), 27 (3), pages 411 to 436, arrangements for sound cancellation in ducts were described in which upstream sound from sound sources producing cancellation were reduced, at least theoretically, to zero at all frequencies while the downstream output of the sources varied with frequency but was effective for cancellation over useful practical frequency ranges (see also U.K. Specification No. 1,456,018 and its U.S. counterpart U.S. Pat. No. 4,044,203).

The damping and downstream cancellation of sound described in the above-mentioned paper relied on using at least two sound sources in which the sound produced by the downstream source was constrained to be in phase opposition with the sound produced by the upstream source just upstream from that source.

U.K. Specification No. 1,548,362 and its U.S. counterpart U.S. Pat. No. 4,171,465 describe an arrangement which is similar to that mentioned above as far as phasing of two sound sources is concerned but a detector for use in driving the sound sources is positioned downstream of the upstream source instead of vice versa.

According to a first aspect of the present invention there is provided apparatus for the directional reduction of sound, comprising first and second electrically driven sound sources for positioning in the path of sound to be reduced with the first source nearer to the source of the said sound than the second source, signal-generating means for generating a drive signal to drive the first source, and processing means for so processing the drive signal and applying it to drive the second source that sound generated by the first and second sources is, or tends to be, in phase at all frequencies of interest on that side of the second source which is remote from the first source, and the signal-generating means and the processing means being such that the resultant sound on the said side of the second source tends to be in anti-phase with sound to be cancelled at all the said frequencies.

The main advantage of the present invention is that the downstream output of the first and second sources is at a maximum value at all frequencies and therefore provides maximum cancellation of the sound to be reduced. This is in contrast to the proposals in the above-mentioned patent specifications where at certain frequencies the downstream output of the two sources fell to zero thus preventing cancellation and control at these frequencies. The output from the two sources in the upstream direction is generally of reduced amplitude and therefore provides a degree of absorption at most frequencies. The penalty is that there are certain frequencies at which the outputs of the two sources reinforce each other in the upstream direction and at these frequencies the two sources can be regarded as being a pure reflector. Experiments have shown that in general it is unnecessary to provide perfect absorption, but that a degree of absorption can significantly improve the characteristics of an active silencing system, particularly in ducts.

Each of the first and second sources may be an array of sources driven in phase and, for sound cancellation in ducts, located around the same duct cross-section.

Any practical number of further sound sources may be provided when the signal generating means is constructed and/or arranged to generate a respective drive signal for each further source, these drive signals being such that, at all frequencies of interest, the sound generated by each of the sources is in phase, on that side of the further source which is remote from the first source, with the resultant sound generated by other sources of the apparatus which are nearer to the source of the sound to be reduced.

The signal generating means usually includes a detector for detecting the sound to be reduced, the detector being positioned either nearer to the source of the sound to be reduced than the first source or between the first and second sources, or where there are more sources somewhere between the sources of the apparatus. The detector may, for example, be formed by an array of microphones positioned in a duct and coupled by means of appropriate delays to detect only sounds travelling along the duct away from the source of sound to be reduced.

Where the detector is nearer to the source of sound to be reduced than the first source it is coupled to the first source by means of a processor, constructed according to known techniques, with output coupled to the first source. The advantage of an upstream detector of this type is that it allows the processor time to calculate and generate a suitable drive signal for the first source but, due to varying propagation conditions for example, the detected sound may have changed character by the time it reaches the first and second sources so that errors occur. Where the detector is positioned among the sound sources of the apparatus the arrangement is, as is explained in more detail below, less susceptible to errors in cancellation.

In an arrangment where the detector is between the first and second sources and no other sources are included in the apparatus, the detector may be coupled to a node at which the signal driving the first source is added to the detector signal. Further the signal driving the second source after passing through a delay equal to the time taken for sound to propagate from the second source to the detector is subtracted at the node and the resultant signal is applied to an amplifier whose output provides the drive signal for the first source.

According to a second aspect of the present invention there is provided a method for the directional reduction of sound comprising generating first and second sound waves at first and second positions respectively in the path of sound to be reduced, with the first position nearer to the source of the said sound than the second position, the first and second sounds being, or tending to be, in phase at all frequencies of interest on that side of the second position which is remote from the first position and the resultant sound wave tending to be in anti-phase at all frequencies of interest with sound to be cancelled on the said side of the second position.

Figure 2:
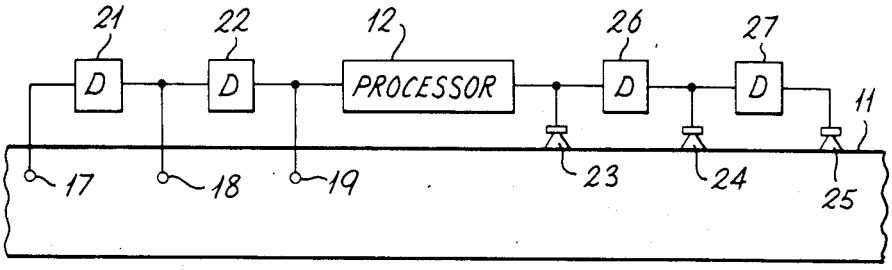
Figure 3:
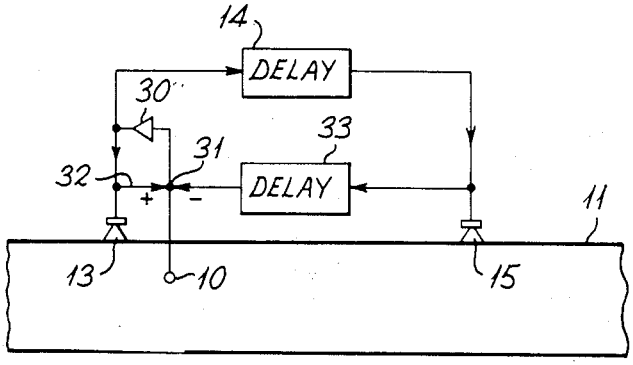
Figure 4:
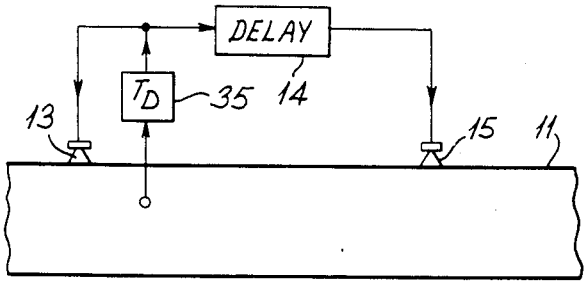

Certain embodiments of the invention will now be described, by way of example, with reference to the accompanying drawings, in which:

FIG. 1 is a block diagram of apparatus according to the first aspect of the present invention, FIG. 2 is a block diagram of apparatus according to the invention in which a detector having a plurality of microphones is employed and sound cancellation is achieved by three sound sources, FIG. 3 is a block diagram of apparatus according to the invention using a detector which is downstream from a first sound cancelling source, and FIG. 4 is a generalised block diagram of apparatus according to the invention having two sound sources with a detector between the two sources.

In FIG. 1 a sound detector 10 such as a microphone is positioned within a duct 11 which can be regarded as carrying sound in the form of plane waves. The detector 10 is connected by way of a processor circuit 12 to a first sound source 13, such as a loudspeaker, or an array of loudspeakers distributed round the duct at one cross-section thereof, and positioned to generate sounds within the duct. The output of the processor 12 is also passed to a delay circuit 14 with output connected to another sound source 15 which may be of the same form as the source 13.

The delay 14 is such that sound waves generated by the sources 13 and 15 are in phase downstream of the source 15 (that is to the right of the source 15 in FIG. 1) at all frequencies, and by means of the processor 12 the sound wave so produced is in anti-phase, just downstream of the source 15, with sound travelling down the duct but originating upstream from the detector 10. The phasing and amplitude of the combined sound waves from the sources 13 and 15 downstream of these sources is predicted by the processor 12 from signals picked up by the detector 10. Many forms of such processor are known, for example as described in the Journal of Sound and Vibration (1983) 91 (3) pages 351 to 362 "An Experimental Study of a Broadband Active Attenuator for Cancellation of Random Noise in Ducts" by R. F. la Fontaine and I. C. Shepherd, but modification may be necessary in view of the delay 14.

The arrangement shown in FIG. 1 has the advantage that maximum destructive interference with sounds travelling down the duct is provided by the sources 13 and 15 at all frequencies of interest while an appreciable amount of damping is provided by the upstream source. Time and frequency domain expressions can be derived for sound waves generated by an array of sources when the output of each source is combined in anti-phase in the duct with the sound output of the next upstream source in the array. Such expressions are shown on page 423 of the above-mentioned 1973 paper and it is apparent that in the frequency domain the output of the array comprises a constant coefficient and an expression in the form: one minus an exponential. Although the phasing of the sources in the array of FIG. 1 is fundamentally different from the arrangment described in the 1973 paper the frequency domain form of the output wave is the same in that it comprises a coefficient and a component which includes an exponential. In the calculations and expressions which follow in the specification the amplitudes of the sources have been normalised so that a unit source is assumed to generate unit pressure. In practice, appropriate gain factors (possibly frequency dependent) are included, either explicitly or implicitly, in the circuits 12 and 14 in order to achieve this objective. In addition the effects of Mach number have been ignored since for practical purposes in most situations low gas flows only occur so that Mach number is a secondary effect. However from the 1973 paper it will be clear how the effects of Mach number can be taken into account.

With these provisos the present configuration can be regarded as giving a downstream sound pressure of $1+1=2$ at all frequencies if the sources 13 and 15 produce unit output. This output is used to cancel the incident disturbance. The component upstream of the source 13 has the sound pressure 1; $+e^{-i\omega 2\tau}$ (where $\tau$ is the delay 14, $\omega$ is angular frequency and 'i' indicates an imaginary number). This latter expression is frequency dependent and it is less than '2' at most frequencies, so yielding a reflected wave which is of reduced amplitude compared to the incident wave. This corresponds to providing damping at most frequencies.

The number of detectors and sound sources, or arrays of sound sources, is, of course, not limited to one and two respectively. Thus in FIG. 2 three detectors or arrays of detectors 17, 18 and 19 are shown coupled by delays 21 and 22, these delays being such that the detector array preferentially detects waves propagating downstream. The more detectors used the more accurate this detection is and therefore any appropriate number of detectors or detector arrays may be used. The delays 21 and 22 have values and can be constructed according to known principles. FIG. 2 also shows three sound sources 23, 24 and 25 separated by delays 26 and 27. The sources 24 and 25 generate sound waves which are in phase with waves from the next upstream source. Again any appropriate number of sources can be used and fed by delays which give the required phasing. The more sources used the more the output conforms with the requirement of cancelling sound travelling down the duct and the more damping is provided to prevent reflection of sound in the upstream direction.

FIG. 3 shows an arrangement in which the microphone 10 is positioned between the sound sources 13 and 15, just downstream of 13, and the delay 14 is used for the same purpose as previously, this arrangment having the advantage, mentioned above, that it is less susceptible to errors in cancellation performance; that is if sound cancellation is not complete, as always occurs in practice, the error does not cause larger errors to develop. In fact in FIG. 3 there is a tendency for the net effect of any errors to be reduced. The upstream source 13 acts to cancel the incoming wave partially, reducing its amplitude to half its initial value and the downstream source 15 completes the cancellation process, reducing the incoming wave amplitude substantially to zero. If the upstream source produces a sound pressure $m_p(t)$ and the downstream source produces a sound pressure $m_s(t)$ then $$m_p(t) = -\tfrac{1}{2}f_o\left(t - \frac{x}{c_o}\right), \text{ (where } x = 0\text{), and}$$

$$m_s(t) = m_p(t-\tau) = -\tfrac{1}{2}f_o(t-\tau)$$

where $f_o$ represents the incident sound wave to be cancelled t is time x is distance from the source 13

$c_o$ is the speed of sound, and $\tau$ equals $L/c_o$, L being the distance between the sources 13 and 15.

The expressions for $m_p(t)$ and $m_s(t)$ define the desired outputs from the sources.

The detector 10 together with a high gain amplifier 30 and the source 13 constitute a closed loop feedback control system and in general such systems are designed to drive the detector output to a null, whereas in this case it is only required to reduced the amplitude of the incident wave by a half. This objective can be achieved by causing the null to occur instead at a node 31 by modifying the detector output in two ways:

(1) an additional signal is added by means of a connection 32 to the signal generated by the source 13; thus, in effect, the signal applied to the node 31 is made twice that generated at the output of the source 13;

(2) since the microphone 10 receives signals from the source 15 and these signals are not required in the feedback loop they are in effect removed by subtraction at the node 31 of signals from a delay 33 which models the delay and path between the source 15 and the detector 10.

The signal picked up by the detector 10 is $$d_s = f_o\left(t - \frac{x}{c_o}\right) + m_p(t) + m_s(t - \tau) \text{ (where } x = 0)$$

The signal at the node 31 is given by $$S_n(t) = f_o(t) + m_p(t) + m_s(t - \tau) + \{m_p(t) - m_s(t - \tau)\}$$
$$= f_o(t) + 2m_p(t)$$

If conventional negative feedback is now applied with high gain to control the signal at the node 31, in frequency domain notation, $$m_p(i\omega) = -GS_N(i\omega),$$

where G is the gain of the amplifier 30, whence, $$S_N(i\omega) = f_o(i\omega) - 2G\, S_N(i\omega)$$

i.e.

$$S_N(i\omega) = f_o(i\omega)/(1+2G)$$

and $$m_p(i\omega) = -G\, f_o(i\omega)/(1+2G)$$

Thus as G is increased, $S_N(i\omega)$ is driven to zero with increasing accuracy while $$m_p(i\omega) \rightarrow -f_o/2$$

i.e.

$$m_p(t) \quad \underline{\Omega} f_o(t)/2$$

and $$m_s(t) = m_p(t - \tau)$$

which are the required outputs.

FIG. 4 shows a more general form of the arrangement of FIG. 3 where a circuit 35 having a transfer function $T_D$ is connected between the detector 10 and the input to both the source 13 and the delay 14. (Thus the transfer function $T_D$ for the circuit of FIG. 3 is that resulting from the amplifier 30, the node 31 and the delay 33). The total downstream output is now $$f_o\left(t - \frac{x}{c_o}\right) + m_p\left(t - \frac{x}{c_o}\right) + m_s\left(t - \frac{(x - L)}{c_o}\right) \text{ (for } x \geqq L) = f_o\left(t - \frac{x}{c_o}\right) + m_p\left(t - \frac{x}{c_o}\right) + m_p\left(t - \frac{(x - L)}{c_o}\right) - \tau\Big)$$

$$\text{since } m_s(t) = m_p(t - \tau) = f_o\left(t - \frac{x}{c_o}\right) + 2m_p\left(t - \frac{x}{c_o}\right) \text{ (for } x \geqq L), \text{ noting } \tau = \frac{L}{c_o}$$

For this output to be zero, $m_p(t)$ should equal $-\frac{1}{2}f_o(t)$.

The output of the detector 10 is $$d(t) = f_o(t) + m_p(t) + m_s(t - \tau)$$
$$= f_o(t) + m_p(t) + m_p(t) + m_p(t - 2\tau)$$

Hence, in frequency domain notation the output of the detector 10 is $$d(i\omega) = f_o(i\omega) + m_p(i\omega)\,[1 + e^{-2i\omega\tau}] \qquad \text{equation 1}$$

In this example transfer function $T_D$ is required to be such that $$m_p(i\omega) = -\tfrac{1}{2}f_o(i\omega)$$

So $T_D d(i\omega)$ should equal $-\frac{1}{2}f_o(i\omega)$ and if this is achieved, $$d(i\omega) = f_o(i\omega) - \tfrac{1}{2}f_o(i\omega)\,[1 + e^{-2i\omega\tau}]$$

from equation 1.

Thus $$T_D\{f_o(i\omega) - \tfrac{1}{2}f_o(i\omega)\,[1 + e^{-2i\omega\tau}]\} = -\tfrac{1}{2}f_o(i\omega)$$

whence $$T_D\{\tfrac{1}{2}f_o(i\omega)(1 - e^{-2i\omega\tau})\} = -\tfrac{1}{2}f_o(i\omega)$$

and the general expression for $T_D$ is $$T_D = -1/(1 - e^{-2i\omega\tau}).$$

As an alternative to the realisation of FIG. 3, this function can be implemented by a simple feedback circuit involving a time delay $2\tau$, and such a circuit is similar in its general characteristics to the array compensation networks described in U.K. Specification No. 1,456,018, which do not embody the present invention.

In practice it will not be possible to implement $T_D$ precisely, so it is appropriate to examine the accuracy of operation of the system given small errors in the realisation of $T_D$. This particular characteristic, namely the sensitivity to error of a given source detector configuration, has been discussed in general terms by the present inventor in the paper "The Active Control of Low Frequency Sound in a Gas Turbine Installation", Inter-Noise 82 page 423.

In the specific case considered here, the sensitivity to error can be shown to be (0.5) $(1-e^{-i\omega 2\tau})$. This can be compared with the equivalent result for an arrangement in which the upstream source 13 is simply omitted. In the latter case, exactly the same expression for $T_D$ is required, but the sensitivity to error then becomes $(1-e^{-i\omega 2\tau})$, i.e. the overall sensitivity to errors in $T_D$ has been halved by the introduction of the source 13.

It is also interesting to compare the sensitivity to error of the arrangements of FIGS. 3 and 4 to the system described in U.K. Specification No. 1,548,362, where, as far as possible, perfect damping is provided upstream at all frequencies, but cancellation downstream is simply not possible at certain frequencies. The system of U.K. Specification No. 1,548,362 gives a sensitivity to error which is constant with frequency and equal to unity, which corresponds to the worst value of susceptibility of FIGS. 3 and 4.

It will be clear from the specific embodiments of the invention described above that the invention can be put into practice in many other ways with different detector and source arrangments, each with various intervening delays. In particular, it is sometimes useful to replace the simple delay 14 by an adaptive filter (such as of the form given in the above-mentioned paper by la Fontaine and Shepherd), using a downstream monitoring detector to operate a controller optimising the parameters of the filter for sound cancellation. A further improvement in the accuracy of operation of the overall system is then obtained. However such an arrangement sometimes causes small departures from the criterion that the first and second sources are in phase at all frequencies of interest just downstream of the second source. For example in the arrangement of FIG. 3 some signals generated by the source 13 may not have quite the correct phase to cancel incident signals and their amplitudes may not be exactly half the incident amplitudes. With an adaptive filter the opportunity arises to correct these errors with the result that some signals from the source 15 are not quite in phase with those from the source 13 and not of exactly half their amplitude. However such an arrangement tends to generate signals which are in phase and which together tend to cancel the incident signals downstream of the source 15.

As alternatives to the transfer functions mentioned, other transfer functions between the detectors and the sources involving feedback or feedforward may also be used provided at least one downstream source provides an output just downstream of another source which is, or tends to be, in phase with the output of that other source.

The Figures show arrangements for use in ducts but provided a reasonably directional sound beam is being generated or a directional zone of cancellation is required then the principles of the invention, for example as exemplified in the Figures, can be applied to such beams or zones.

I claim:

1. Apparatus for the directional reduction of sound, comprising first and second electrically driven sound sources for positioning in the path of sound to be reduced with the first source nearer to the source of the said sound than the second source, signal-generating means for generating a drive signal to drive the first source, and processing means for so processing the drive signal and applying it to drive the second source that sound generated by the first and second sources tends to be in phase at all frequencies of interest on that side of the second source which is remote from the first source, and the signal-generating means and the processing means being such that the resultant generated sound on the said side of the second source tends to be in anti-phase with sound to be cancelled at all the said frequencies.

2. Apparatus according to claim 1 including a number of further sound sources, wherein the signal generating means is arranged to generate a respective drive signal for each further source, the drive signals being such that, at all frequencies of interest, the sound generated by each of the sources is in phase, on that side of the further source which is remote from the first source, with the resultant sound generated by other sources of the apparatus which are nearer to the source of the sound to be reduced.

3. Apparatus according to claim 1 wherein the signal generating means includes a detector for detecting the sound to be reduced, the detector being positioned nearer to the source of the sound to be reduced than the first source.

4. Apparatus according to claim 1 wherein the signal generating means includes a detector for detecting the sound to be reduced, the detector being positioned among the said sources of the apparatus.

5. Apparatus according to claim 4 including delay means which models the sound path between the second source and the detector, wherein the detector is coupled to a node at which the drive signal for the first source is added to the output signal of the detector and the output signal of the delay means is subtracted to form a resultant signal which is applied to an amplifier, the output signal of the amplifier forming the drive signal for the first source.

6. Apparatus according to claim 1 wherein at least one of the first and second sources comprises an array of sources driven in phase.

7. Apparatus according to claim 1 wherein the processing means comprises a delay circuit.

8. Apparatus according to claim 1 wherein the processing means comprises an adaptive filter.

9. Apparatus according to claim 1 arranged for the reduction of sound in a duct.

10. Apparatus according to claim 9 wherein the detector comprises an array of microphones positioned in the duct and coupled by means of appropriate delays to detect only sounds travelling along the duct away from the source of sound to be reduced.

11. A method for the directional reduction of sound comprising generating first and second sound waves at first and second positions respectively in the path of sound to be reduced, with the first position nearer to the source of the said sound than the second position, the first and second sounds being, or tending to be, in phase at all frequencies of interest on that side of the second position which is remote from the first position and the resultant generated sound wave tending to be in anti-phase at all frequencies of interest with sound to be cancelled on the said side of the second position.

12. Apparatus for the directional reduction of sound, comprising first and second electrically driven sound sources for positioning in the path of sound to be reduced with the first source nearer to the source of the said sound than the second source, signal-generating means for generating a drive signal to drive the first source, and processing means for so processing the drive signal and applying it to drive the second source that sound generated by the first and second sources tends to be in phase at all frequencies of interest on that side of the second source which is remote from the first source, and the signal-generating means and the processing means being such that the resultant generated sound on the said side of the second source tends to be in anti-phase with sound to be cancelled at all the said frequencies, said signal generating means including a detector for detecting the sound to be reduced, the detector being positioned among the said sources of the apparatus, said detector being coupled by way of means having a transfer function $T_D$ to the input of the first source to provide the said drive signal, and $T_D$ is equal to $-1/(1-e^{-2i\omega\tau})$, where i is $\sqrt{-1}$, $\omega$ is angular frequency and $\tau$ is delay imparted by the processing means.

* * * * *